US007559544B2

(12) United States Patent
Behrens et al.

(10) Patent No.: US 7,559,544 B2
(45) Date of Patent: Jul. 14, 2009

(54) DEVICE AND METHOD FOR SINGLY SEPARATING PRINTING PLATE OF A STACK

(75) Inventors: Gunnar Behrens, Kiel (DE); Axel Trilk, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 264 days.

(21) Appl. No.: 11/247,554

(22) Filed: Oct. 11, 2005

(65) Prior Publication Data

US 2006/0180983 A1 Aug. 17, 2006

(30) Foreign Application Priority Data

Oct. 8, 2004 (DE) ..... 10 2004 049 385

(51) Int. Cl.
*B65H 3/46* (2006.01)

(52) U.S. Cl. ..... 271/106; 271/107; 271/103

(58) Field of Classification Search ..... 271/90, 271/102, 106, 103, 107
See application file for complete search history.

(56) References Cited

U.S. PATENT DOCUMENTS 4,177,983 A 12/1979 Wossler
5,921,541 A * 7/1999 Hansch ..... 271/106
6,607,192 B2 * 8/2003 Ono et al. ..... 271/90
2004/0112233 A1 6/2004 Shibabuki et al.

FOREIGN PATENT DOCUMENTS

| | | | |
|---|---|---|---|
| DE | 26 59 421 | A1 | 7/1978 |
| DE | 91 00 269.9 | U1 | 8/1991 |
| DE | 198 54 826 | A1 | 6/2000 |
| EP | 1 428 778 | A1 | 6/2004 |
| JP | 54115871 | | 9/1979 |
| JP | 06199435 | A * | 7/1994 |

* cited by examiner

*Primary Examiner*—Kaitlin S Joerger
(74) *Attorney, Agent, or Firm*—Laurence A. Greenberg; Werner H. Stemer; Ralph E. Locher

(57) ABSTRACT

A device is provided for singly separating flat objects of different flexibility from a stack preferably being formed of printing plates and flexible interleaves. At least one suction element sucks up an object with a suction air flow. At least one form element at least approximately encloses the at least one suction element. The at least one form element has boundaries being spaced from the at least one suction element. A method of operating the device is also provided.

4 Claims, 4 Drawing Sheets

DEVICE AND METHOD FOR SINGLY SEPARATING PRINTING PLATE OF A STACK

BACKGROUND OF THE INVENTION

Field of the Invention

The invention relates to a device for singly separating flat objects of varying flexibility from a stack preferably being formed of printing plates and flexible interleaves. The invention, furthermore, relates to a method of singly separating flat objects of varying flexibility from a stack preferably being formed of printing plates and flexible interleaves.

In order to carry out single processing, flat objects stacked on top of one another in a stack and especially supplied in such a stack must initially be singly separated and then singly fed successively into a processing machine. Printing plates, especially, must therefore also be inserted singly into a printing plate developer for their development. That may be effected manually. However, for reasons of working economy, an automatic loader may be preferred, to which a printing plate developer may be respectively preconnected and predocked. A stack of printing plates to be developed is inserted into the loader, which should be available through a singling separation device of the aforementioned type, in order to permit an automatic singling separation and loading.

The singling separation process and loading process may, however, be disrupted thereby, and impair or preclude subsequent handling or processing, so that several flat objects adhere to one another, whereby there may be, for example, two objects of like rigidity, such as, for example, two printing plates, or of different flexibility, such as a printing plate and an interleaf, which is supposed to separate the printing plate from a succeeding or preceding printing plate in the stack. Interleaves, for example paper sheets, serve for separating printing plates. Such interleaves may also not be provided or, in the exceptional case, may be inadvertently omitted or may exist in a double-layered state.

In order to separate the objects, the latter may be respectively lifted singly by a lifting device. That lifting device may, for example, include suction elements, which suck up the objects and interleaves. Double sheets may thereby result. By double sheets, there are meant or denoted objects which adhere to one another, such as printing plates and/or interleaves, so that several may be lifted at the same time by the lifting device. Those double sheets must then be separated from one another in a suitable manner.

Different materials may be used as interleaves, depending upon the manufacturer. It may happen that a porous material, for example porous paper, is used as an interleaf. In that case, the suction elements set the lifting device on an interleaf, and the resulting vacuum also acts on the underlying object. In that case, the double sheets are held and sucked up by the suction elements. Those double sheets may in fact be detected by sensors. However, the separation is more complicated in that case than if the double sheets, for example, adhere to one another by electrostatic forces. Furthermore, with those interleaves, the formation of double sheets regularly occurs, due to which the singly separating process is at least impeded.

SUMMARY OF THE INVENTION

It is accordingly an object of the invention to provide a device and a method for singly separating printing plates of a stack, which overcome the hereinafore-mentioned disadvantages of the heretofore-known devices and methods of this general type, with which the occurrence of double sheets is often avoided and which increase the flexibility of the singly separating device, in such a way that stacks with porous interleaves may also be singly separated.

With the foregoing and other objects in view, there is provided, in accordance with the invention, a device for singly separating flat objects of different flexibility from a stack preferably formed of printing plates and flexible interleaves. The device comprises at least one suction element for sucking up an object with a suction air flow. At least one form element at least approximately encloses the at least one suction element. Boundaries of the at least one form element are spaced from the at least one suction element.

In accordance with another feature of the invention, the boundaries form and enclose a lower surface. The lower surface lies at least approximately parallel to the objects and is spaced from a suction surface of the suction element in such a way that the suction surface lies underneath the lower surface enclosed by the boundaries, in an inactive condition. The suction surface becomes deformed in such a way that when a flexible object is sucked up, the deformed suction surface at least approximately lies above the lower surface enclosed by the boundaries, with air channels being formed beneath the flexible object.

In accordance with a further feature of the invention, the boundaries are formed with recesses or notches deviating formwise or in shape from the plane of the lower surface.

In accordance with an added feature of the invention, first recesses or notches are in the form of at least one groove.

In accordance with an additional feature of the invention, the boundaries are formed with further recesses or notches disposed in a direction different from that of the groove.

In accordance with yet another feature of the invention, the suction element is deformable in a direction corresponding to that of the suction air flow.

With the objects of the invention in view, there is also provided a method for singly separating flat objects of different flexibility from a stack, preferably formed of printing plates and flexible interleaves. The method comprises sucking up the objects, including at least one flexible object, by at least one suction element. The at least one flexible object is deformed when it is being sucked up, so that it forms at least at least one air channel therebeneath.

In accordance with a concomitant mode, the method of the invention further includes supplying air at the outer air pressure through the air channel.

Thus, an object of the invention is thereby accomplished in that the device has at least one suction element at least approximately enclosed by at least one form element with boundaries spaced from the suction element. A frame, for example, which encloses the suction element may be associated with this form element. A compact form, which encloses the suction element and thus has a lower opening through which the suction element extends, may be further provided.

The suction element has a suction surface, which is peripherally delimited by a so-called suction lip. Both the suction surface as well as the suction lip, are rubber-elastic. If a rigid object, such as an inflexible printing plate, is sucked up, they will form an at least approximately flat plane. If a less rigid object such as a flexible interleaf is sucked up by the at least one suction element, the suction surface will so deform the interleaf, that it advantageously, as is provided according to the method, forms at least one air channel thereunder. Air at the outer air pressure can be supplied thereover, and at least the interleaf may be loosened more readily from a printing plate. According to the invention, the boundaries advantageously make it possible for the interleaves, when sucked up by at least one suction element, to become deformed and form air channels thereunder.

If the interleaf is formed of a porous material, and a further object is located thereunder, the further object can thus no longer be sucked up, because a vacuum may no longer be able to act through the respective air channels and deformed suction surface. In the case of porous interleaves, air will come gushing through the air channels. Thus, according to the invention, the formation of double sheets can no longer occur.

In accordance with a further development of the invention, it is provided that the boundaries form and enclose a lower surface which lies approximately parallel to the objects and is so spaced from the suction element, that this suction surface lies, in the inactive condition, underneath the surface and, during the sucking-up of a flexible interleaf, is so deformed that it lies approximately above the surface formed by the boundaries, and air channels become formed below the interleaf.

Advantageously, only one flexible interleaf, such as paper or porous paper, for example, may follow the deformed suction surface and thus be drawn over the lower surface of the boundary. A printing plate is too inflexible therefor. Air channels may thus be formed between printing plate and interleaf, air can flow past and the vacuum no longer acts upon the printing plate. Double sheets may be avoided very effectively.

In an especially advantageous development of the invention, the boundaries of the device are formed with recesses or notches, which deviate formwise or in shape from the plane of the lower surface. The development of the air channels may thereby be advanced better, since they are no longer impeded in these regions of the boundary by the boundary itself. If the boundary, for example, is formed of a frame, it may thus be provided that this frame has a rectangular shape, for example. It encloses the suction element. If the suction element then sucks up a flexible interleaf, the suction element and the suction surface will thus then become so deformed, that the suction surface lies at least approximately above the frame. The flexible interleaf follows the deformed suction surface. If a printing plate should, for example, also be sucked up simultaneously, because a porous interleaf is involved, the printing plate is thus too rigid and will not become flexibly deformed, but rather will form an at least approximately flat plane with the lower surface of the frame. An air channel is thus formed between the printing plate and the interleaf. Advantageously, this air channel may thereby become enlarged and may act further between the surface between the printing plate and the interleaf, if the frame, i.e. the boundary, is formed with recesses or notches. The frame may, therefore, be constructed, for example, of different elements, which are separated from one another. The frame forms a lower plane, which acts as a boundary for a sucked-up printing plate. This boundary can be so constructed shapewise, that it leaves at one or more locations of this plane. At these regions, no form-lock occurs between the printing plate and the boundary, and an air channel extending to the outside can in this case then be formed within the boundary between the printing plate and the interleaf. In this regard, it is noted that a form-lock or form-locking connection is one which connects two elements together due to the shape of the elements themselves, as opposed to a force-locking connection, which connects the elements together by force external to the elements. Possibly acting adhesion forces between the printing plate and the Interleaf may advantageously be counteracted. The interleaf may then be loosened better from the printing plate, based already upon the gravitational force from the latter.

In an especially advantageous further development, it is provided that the recesses or notches are formed in the shape of at least one groove. Formwise notches acting along one direction are thereby involved in the boundary. These grooves are then advantageously provided in each form element, which encloses a suction element. These grooves may thus become coordinated with one another, in that the formation of a continuous first air channel is supported by at least several form elements. In this manner, for example, one channel may be formed over the entire width of the printing plate and the interleaf, respectively, and convey air at the outer air pressure between the interleaf and the printing plate.

The development of this first long channel may take quite a long time, so that it is therefore advantageously provided, that in a further development, the boundaries are formed with further recesses or notches extending in a direction different from that of the groove. Air channels will thereby be developed in the form of folds in the interleaf, which form at least a second air channel.

Advantageously, the suction elements act on an edge surface of the flat objects and interleaves, respectively. A connection to the outer air pressure is then rapidly made through the second air channels. They should extend, according to the invention, perpendicularly to the edge of the printing plate, which extends parallel to the lifting device to which the suction elements belong. The spacing to this edge is also very small. In this case, air at the outer air pressure is conducted between the flat object and the interleaf. The action of the vacuum is no longer sufficient enough for sucking up the flat object, i.e., the printing plate. The first air channel which lies parallel to the one edge of the interleaves is formed by the grooves in the form elements. In this case, the adhesion between the flat object and the interleaf is neutralized over a large area, and sucking up the flat object is also effectively counteracted.

In the afore-described manner, the formation of double sheets may be better avoided, and the use of porous paper as the interleaf is also possible.

If only a printing plate is sucked up, it thus behaves rather rigidly. A suction element will then form an at least approximately flat plane with the printing plate and indeed in the vicinity of the lower surface of the boundary. The printing plate may thus be lifted easily.

In an especially advantageous further development of the invention it is provided that the suction element is deformable in the direction of the suction air flow. This at least supports the suction surface being withdrawn behind the plane of the boundary, in an activated condition, i.e., with a sucked up flexible object.

The described device and the described method also counteract the formation of double sheets formed of two interleaves. The first interleaf has already been sucked up, before a contact between the suction element and the stack has occurred. Due to the then following deformation of the suction surface and the suction lip, because the flexible interleaf has been sucked into the region above the lower surface of the boundary, no effective form-locking occurs between the suction element and a further interleaf. A double sheet of two interleaves may thus at least be better avoided.

Other features which are considered as characteristic for the invention are set forth in the appended claims.

Although the invention is illustrated and described herein as embodied in a device and a method for singly separating printing plates of a stack, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
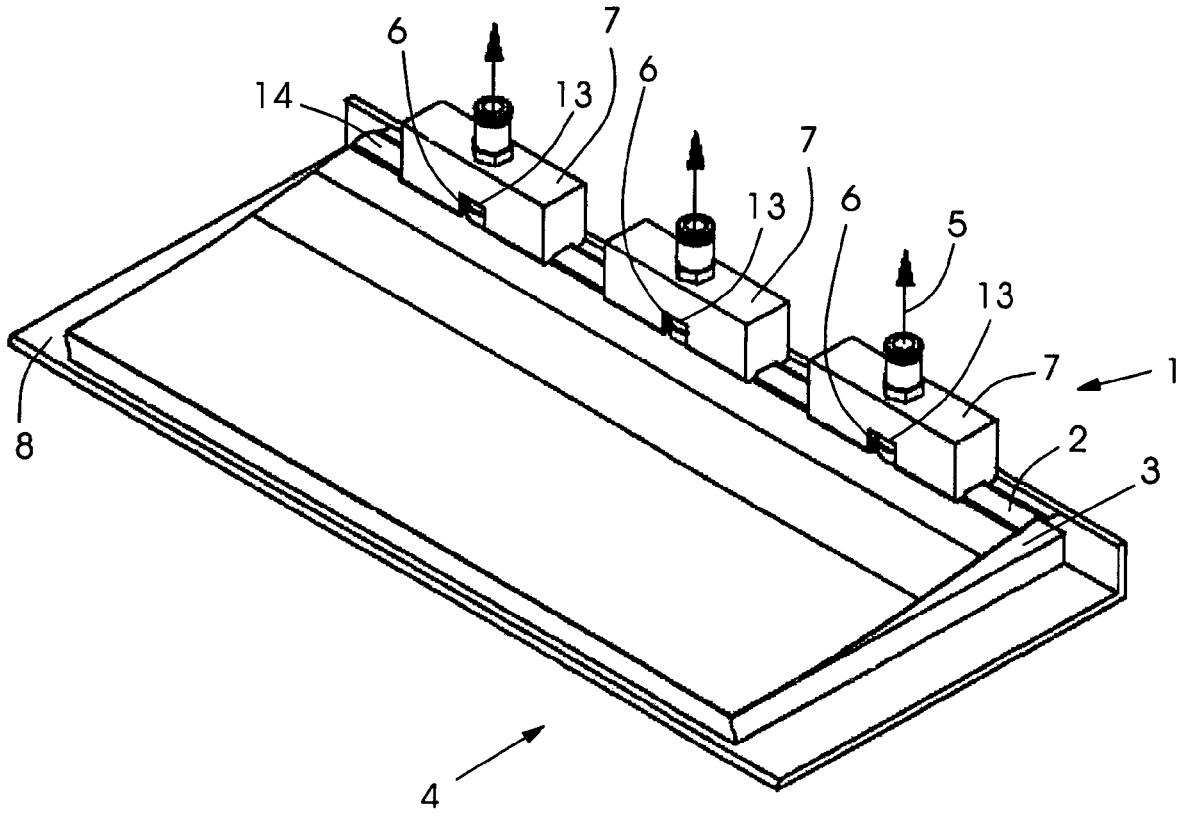
FIG. 1 is a diagrammatic front, side and top perspective view of suction elements of a lifting device with form elements.

Referring now to the figures of the drawings in detail and, first, particularly to FIG. 1 thereof, there are seen diagrammatically illustrated suction elements 6 of a partially illustrated lifting device 1 with form elements 7. A suction air flow is conducted through non-illustrated lines in the direction of arrows 5 through the suction elements 6. Porous interleaves 2 or printing plates 3, which lie on a printing-plate stack 4 within a partly illustrated cassette 8, may thereby be sucked up and then lifted up by the lifting device 1. Non-porous interleaves 2 may also be used. Like elements are illustrated and described below by using like reference characters.

Figure 2:
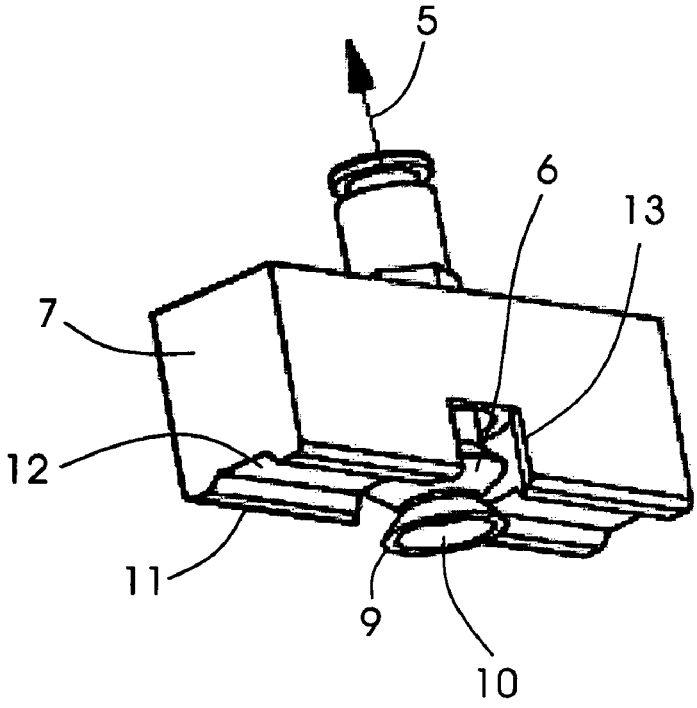
FIG. 2 is an enlarged front, side and bottom perspective view of a suction element of FIG. 1, in inactive condition.

As is represented in FIG. 2, in this case a form element 7 is made up of a compact form surrounding the suction element 6. The form element 7 has a boundary 11 forming and enclosing a lower (edge) surface, which is deformed by first recesses in such a way that a continuous groove 12 is formed at the underside of the form element 7. This groove 12 formed by the first recesses is interrupted only where the form element 7 surrounds the suction element 6. In this region, the form element 7 is formed with a second recess 13. This recess 13 extends perpendicularly to the groove 12. The suction element 6, in the form represented in FIG. 2, is a bellows sucker. In the inactive condition, no object is sucked up. The suction element 6 then has a suction surface 10 at which it is conically shaped and below is edged by a suction lip 9. The suction lip 9 lies, in this regard, below a plane enclosed by the boundary 11. In this condition, suction air can also be led away in the direction of the arrow 5 through the suction element 6.

Figure 3:
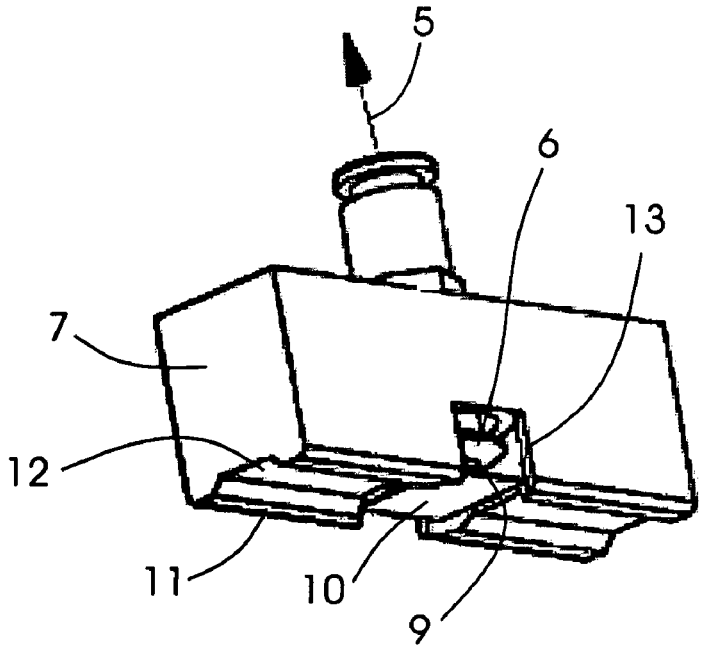
FIG. 3 is a view similar to that of FIG. 2, of the suction element of FIG. 1 deformed in an activated condition.

In FIG. 3, there is shown a deformed suction element 6 in an activated condition. In this condition, a flexible flat object, such as an interleaf, for example, is sucked up. The suction element 6 and the suction lips 9 are deformed in the direction of the suction air flow 5, in such a way that the suction surface 10 becomes withdrawn behind the plane formed by the boundary 11.

Figure 4:
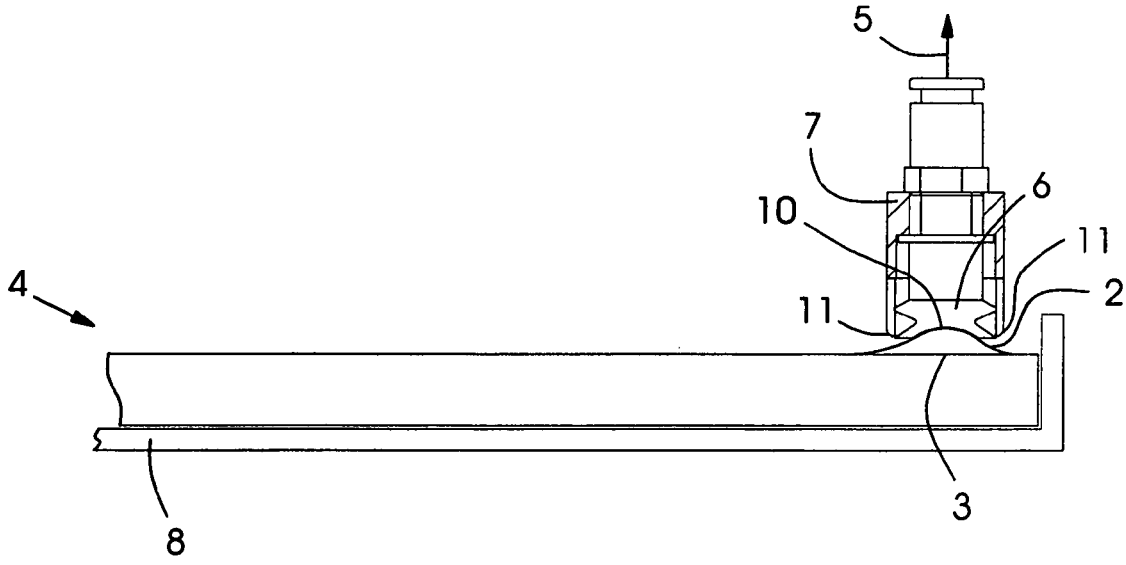
FIG. 4 is a fragmentary, cross-sectional view of a suction element when an Interleaf is sucked up.

FIG. 4 is a cross-sectional view through a suction element 6 when an interleaf is being sucked up. The suction element 6 is moved by the partially represented lifting device 1 towards the stack 4, but does not yet make contact therewith in this case. The interleaf 2 has already become sucked up to such an extent that it covers the suction surface 10. Thus, the suction element 6 is shortened and the suction lip 9 is deformed to such an extent that the suction surface 10 and the suction lip 9 within the groove 12, as represented in FIG. 2 and FIG. 3, lie behind the plane formed by the boundary 11. In this step of the method, only the interleaf 2 alone is sucked up.

Figure 5:
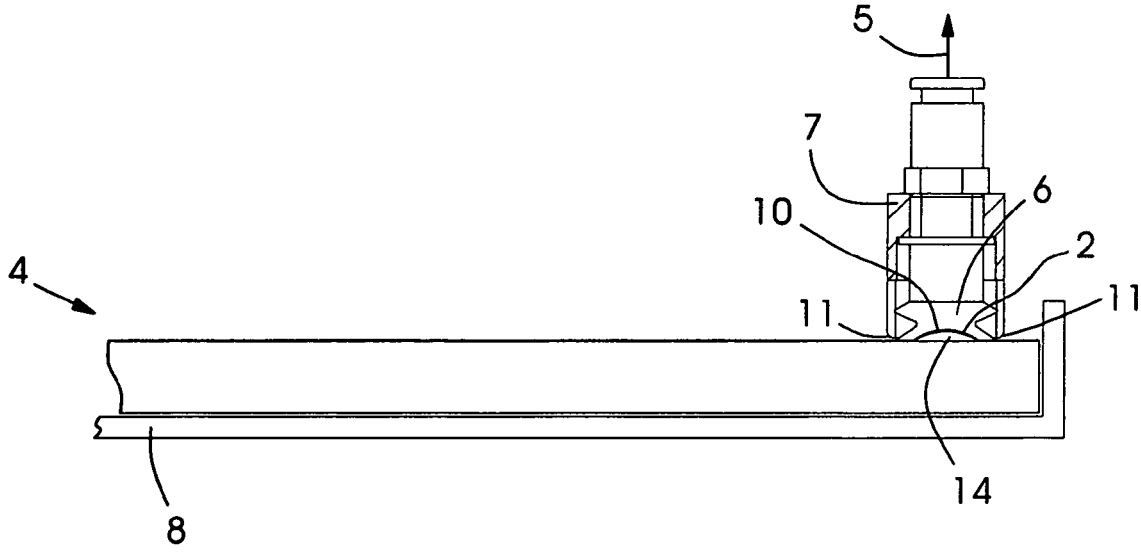
FIG. 5 is a fragmentary, cross-sectional view similar to that of FIG. 4, of the suction element with an air channel.

In FIG. 5, the same suction element 6 as in FIG. 4 is represented in cross section at a later instant of time. In this case, the suction element 6 is located in contact with the stack 4, i.e. it has been lowered that far by the lifting device 1 which is only partially illustrated. The Interleaf 2 is drawn so far behind the boundary 11, that a first air channel 14 has been formed therebelow. This air channel 14 runs along the groove 12 and can thus be built up between the individual suction elements 6, as they are represented in FIG. 1. Along the air channel 14, air at outer or ambient air pressure may then arrive between the interleaf 2 and the next following object, in this case a printing plate 3. The objects can thus be singly separated, and even with porous interleaves 2, a double sheet does not regularly occur, because the following object is decoupled by the air channel 14 from the vacuum, which acts under the suction surface 10.

Figure 6:
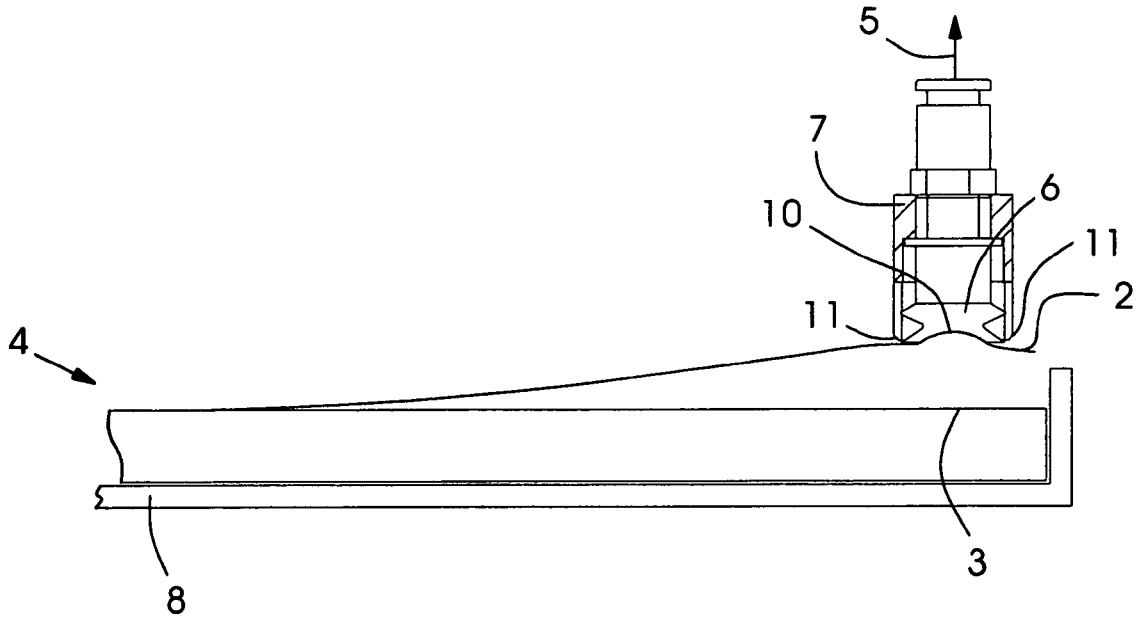
FIG. 6 is a fragmentary, cross-sectional view similar to those of FIGS. 4 and 5, of a suction element with a sucked-up flexible object.

FIG. 6 is a further cross-sectional representation which shows how in this manner a porous interleaf 2 can also be lifted by the suction element 6 through the lifting device 1 which is partially illustrated. This interleaf 2 may then, in a suitable manner, become singly separated and, for example, it may be further transported and de-vacuumed.

Figure 7:
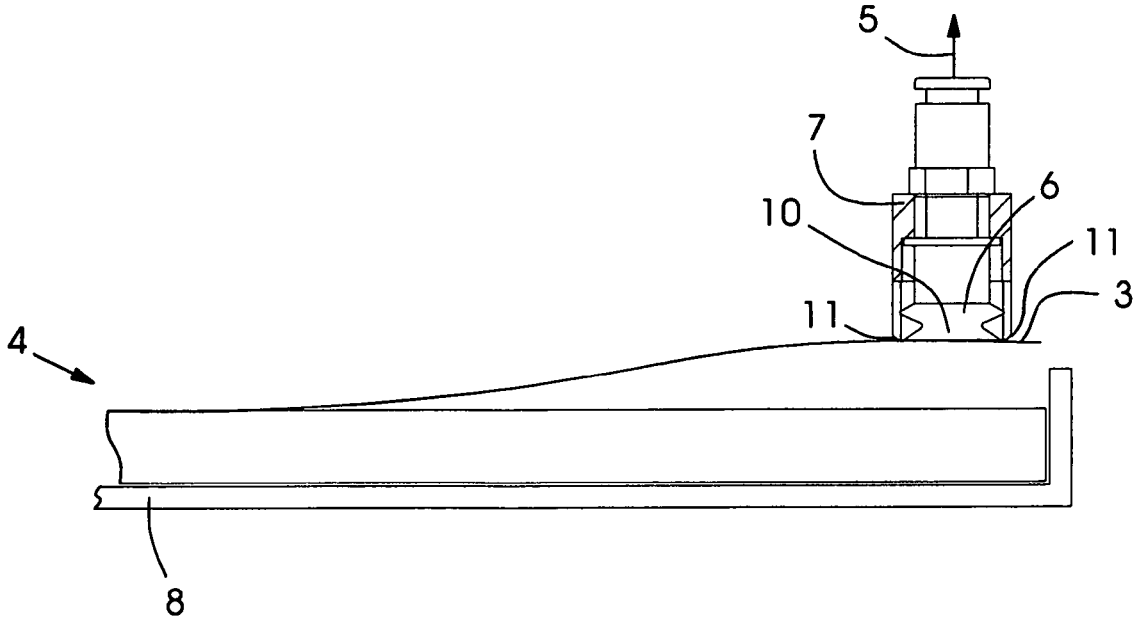
FIG. 7 is a fragmentary, cross-sectional view, similar to those of FIGS. 4, 5 and 6, of a suction element with a sucked-up rigid object.

FIG. 7 represents how a printing plate 3 may be lifted by a suction element 6 through the intermediary of the lifting device 1. The printing plate 3 is a rigid object, which cannot be deformed to such an extent that it becomes drawn behind the boundary 11 by the suction surface 10. Through this interaction with the printing plate 3, the suction surface 10 then forms a flat plane with the printing plate 3 and can lift the latter with support by the lifting device 1, without difficulty. This printing plate 3 can then be fed to a further processing location, for example a plate exposure device.

As is represented in FIGS. 4 and 5, a flexible interleaf 2 is drawn into the region behind the boundary 11. The interleaf 2 is deformed thereby in such a way that it lies in the groove 12 and forms a first channel 14 in this case, which is extended over the entire width of a printing plate 3 and the interleaf 2, respectively. The recess 13 is further represented in FIGS. 2 and 3. In this region as well, the boundary 11 is broken or ruptured to such an extent that the interleaf 2 can become so deformed, that a second non-illustrated air channel can expand from the region inside the form element 7 to the outside. This second air channel runs at least approximately perpendicularly to the first air channel 14. The suction elements 6, in general, are applied to an outer region of the printing plate 3 and the interleaf 2, respectively, so that the printing region of the printing plate 3 does not become damaged. The spacing between the suction element 6 and the edge of the printing plate 3 and of the interleaf 2, respectively, is thus normally not very great in the direction perpendicular to the first air channel 14. Due to the formation of two air channels perpendicular to the first air channel 14, first air at outer air pressure can thus be fed rapidly to the surfaces between successively following objects such as printing plates and/or interleaves, whereby such a suctioning-up of a second object through a porous interleaf 2 is also already avoided. The adhesion between the successively following objects is then even further reduced through the first air channel 14, in the further course of the method. A singling separation can thereby be even better supported. This advantage is also noticeable for non-porous interleaves 2.

With the hereinafore-described device and method of the invention, whereby air channels are formed between successively following objects of different flexibility or for respectively successively following objects with a great flexibility, as is customary for interleaves 2 of a printing-plate stack 4, it is firstly possible to better separate printing plates 3 and interleaves 2 by feeding air at an outer air pressure through an air channel 14 and through second air channels perpendicular thereto, and it is secondly possible to avoid the development of double sheets when porous interleaves 2 are being used. The singly separating device thereby becomes more flexible, because printing plate stacks 4, which have interleaves 2 of porous material, especially paper, also can be singly separated.

This application claims the priority, under 35 U.S.C. § 119, Of German Patent Application DE 10 2004 049 385.5, filed Oct. 8, 2004; the entire disclosure of the prior application is herewith incorporated by reference.

We claim:

1. A device for singly separating flat objects of different flexibility, including rigid printing plates and flexible interleaves, from a stack, the device comprising:

at least one suction element for sucking up an object with a suction air flow, said suction element having a suction surface being peripherally delimited by a suction lip, said suction surface and said suction lip both being rubber-elastic; and at least one form element at least approximately enclosing said at least one suction element, said at least one form element having boundaries spaced from said at least one suction element, said boundaries forming and enclosing a lower surface, said lower surface lying at least approximately parallel to the objects, and said lower surface being spaced from said suction surface, said suction surface lying underneath said lower surface in an inactive condition, and said suction surface being configured to become deformed in a direction of said suction air flow upon sucking up the flexible interleaf causing said deformed suction surface to lie approximately above said lower surface and at least one air channel to be formed beneath the flexible interleaf by deforming the flexible interleaf, and said suction surface and said suction lip being configured for forming a substantially flat plane against the printing plate for preventing a deformation of the printing plate during the sucking up of the printing plate, said boundaries being formed with recesses or notches deviating formwise from a plane defined by said lower surface, said recesses or notches including a first recess forming at least one groove, said recesses or notches including a second recess or notch in a direction different from that of said at least one groove to form at least one second air channel.

2. The device according to claim 1, wherein said suction element is deformable in a direction corresponding to that of said suction air flow to be withdrawn above said lower surface and air channels.

3. A method for singly separating flat objects of different flexibility, including rigid printing plates and flexible interleaves, from a stack, which comprises the following steps:

providing the device according to claim 1;

sucking up the objects, including at least one flexible interleaf, with the at least one suction element supplied with a suction air flow; and deforming the at least one flexible object upon sucking up the at least one flexible object with the at least one suction element, causing the at least one flexible object to form at least one air channel and at least one second air channel beneath the at least one flexible object; and forming a substantially flat plane with the suction surface and the suction lip against the printing plate while sucking up at least one of the printing plates thereby preventing a deformation of the printing plate during sucking up of the printing plate.

4. The method according to claim 3, which further comprises supplying air at outer air pressure through said air channel.

* * * * *